US011702618B2

(12) United States Patent
Simoni et al.

(10) Patent No.: US 11,702,618 B2
(45) Date of Patent: Jul. 18, 2023

(54) COMPOSITIONS COMPRISING 1,2-DICHLORO-1,2-DIFLUOROETHYLENE FOR USE IN CLEANING AND SOLVENT APPLICATIONS

(71) Applicant: THE CHEMOURS COMPANY FC, LLC, Wilmington, DE (US)

(72) Inventors: Luke David Simoni, Wilmington, DE (US); Harrison K Musyimi, Bear, DE (US); Viacheslav A Petrov, Hockessin, DE (US)

(73) Assignee: THE CHEMOURS COMPANY FC, LLC, Wilmington, DE (US)

( * ) Notice: Subject to any disclaimer, the term of this patent is extended or adjusted under 35 U.S.C. 154(b) by 0 days.

(21) Appl. No.: 17/839,729

(22) Filed: Jun. 14, 2022

(65) Prior Publication Data

US 2022/0306972 A1 Sep. 29, 2022

Related U.S. Application Data

(62) Division of application No. 17/279,709, filed as application No. PCT/US2019/054400 on Oct. 3, 2019, now Pat. No. 11,390,830.

(Continued)

(51) Int. Cl.
*C11D 7/50* (2006.01)
*C10M 107/38* (2006.01)

(Continued)

(52) U.S. Cl.
CPC ..... *C11D 7/5018* (2013.01); *C10M 107/38* (2013.01); *C11D 7/5022* (2013.01); *C11D 7/5027* (2013.01); *C11D 7/5059* (2013.01); *C11D 7/5063* (2013.01); *C11D 7/5072* (2013.01); *C11D 7/5086* (2013.01); *C11D 11/0029* (2013.01); *C11D 11/0047* (2013.01);

(Continued)

(58) Field of Classification Search
CPC ... C11D 7/5018; C11D 7/5027; C11D 7/5022; C11D 7/5059; C11D 7/5063; C11D 7/5086; C11D 11/0047; C11D 11/0029; C11D 7/5072; C10M 107/38; C10M 2213/0606; C10N 2050/08
See application file for complete search history.

(56) References Cited

U.S. PATENT DOCUMENTS 5,196,137 A 3/1993 Merchant
6,057,073 A 5/2000 Hagiwara (Continued)

FOREIGN PATENT DOCUMENTS

WO 2012/157761 A1 11/2012

OTHER PUBLICATIONS

Standard Test Method for Evaluating the Effectiveness of Cleaning Agents, ASTM Designation: G122-96 (Reapproved 2002), West Conshohocken, PA.

(Continued)

*Primary Examiner* — Vishal V Vasisth

(57) ABSTRACT

The present application provides compositions comprising 1,2-dichloro-1,2-difluoroethylene (i.e., CFO-1112) and, optionally, an additional component. The present application further provides use of the compositions provided herein in cleaning, solvent, carrier fluid, and deposition applications.

10 Claims, 10 Drawing Sheets

Related U.S. Application Data

(60) Provisional application No. 62/742,116, filed on Oct. 5, 2018.

(51) Int. Cl.
*C11D 11/00* (2006.01)
*C10N 40/14* (2006.01)
*C10N 50/08* (2006.01)

(52) U.S. Cl.
CPC ..... *C10M 2213/0606* (2013.01); *C10N 2040/185* (2020.05); *C10N 2050/08* (2013.01)

(56) References Cited

U.S. PATENT DOCUMENTS

| | | | | |
|---|---|---|---|---|
| 2005/0165108 | A1 | 7/2005 | Rajamahendra | |
| 2009/0270522 | A1 | 10/2009 | Singh | |
| 2011/0107657 | A1 | 5/2011 | Chen | |
| 2015/0231527 | A1* | 8/2015 | Singh | C09K 5/044 252/364 |
| 2016/0333245 | A1* | 11/2016 | Fujii | C10M 105/38 |
| 2021/0139441 | A1* | 5/2021 | Petrov | H01B 3/24 |

OTHER PUBLICATIONS

Doherty et al., Conceptual Design of Distillation Systems, Chapter 5: Homogeneous Azeotropic Distillation, 2001, pp. 185-186, McGraw Hill.

Gao, C. et al., Dip-Coating of Ultra-Thin Liquid Lubricant and its Control for Thin-Film Magnetic Hard Disks, IEEE Transactions on Magnetics, Nov. 1995, pp. 2982-2984, vol. 31, No. 6.

* cited by examiner

COMPOSITIONS COMPRISING 1,2-DICHLORO-1,2-DIFLUOROETHYLENE FOR USE IN CLEANING AND SOLVENT APPLICATIONS

CROSS REFERENCE TO RELATED APPLICATIONS

This application is a divisional application of Ser. No. 17/279,709, filed Mar. 25, 2021, now U.S. Pat. No. 11,390,830 which is a national filing under 35 U.S. C. 371 of International Application No. PCT/US2019/054400 filed Oct. 3, 2019, and claims priority of U.S. Provisional Application No. 62/742,116 filed Oct. 5, 2018, the disclosures of which are incorporated herein by reference in its entirety.

TECHNICAL FIELD

The present application provides compositions comprising 1,2-dichloro-1,2-difluoroethylene (i.e., CFO-1112) and, optionally, an additional component. The compositions described herein may be useful, for example, in which are useful in cleaning, solvent, carrier fluid, and deposition applications.

BACKGROUND

Chlorofluorocarbon (CFC) compounds have been used extensively in the area of semiconductor manufacture to clean surfaces such as magnetic disk media. However, chlorine-containing compounds such as CFC compounds are considered to be detrimental to the Earth's ozone layer. In addition, many of the hydrofluorocarbons used to replace CFC compounds have been found to contribute to global warming. Therefore, there is a need to identify new environmentally safe solvents for cleaning applications, such as removing residual flux, lubricant or oil contaminants, and particles. There is also a need for identification of new solvents for deposition of fluorolubricants and for drying or dewatering of substrates that have been processed in aqueous solutions.

SUMMARY

The present application provides, inter alia, processes for dissolving a solute, comprising contacting and mixing said solute with a sufficient quantity of a composition comprising:

i) 1,2-dichloro-1,2-difluoroethylene; and, optionally, ii) a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy.

The present application further provides processes of cleaning a surface, comprising contacting with said surface a composition comprising:

i) 1,2-dichloro-1,2-difluoroethylene; and, optionally, ii) a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy.

The present application further provides processes for removing at least a portion of water from the surface of a wetted substrate, comprising:

a) contacting the substrate with a composition comprising:

i) 1,2-dichloro-1,2-difluoroethylene; and, optionally, ii) a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy; and b) removing the substrate from contact with the composition.

The present application further provides processes for depositing a fluorolubricant on a surface comprising:

a) combining a fluorolubricant and a solvent, said solvent comprising i) 1,2-dichloro-1,2-difluoroethylene; and, optionally, ii) a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy, to form a lubricant-solvent combination;

b) contacting the lubricant-solvent combination with the surface; and c) evaporating the solvent from the surface to form a fluorolubricant coating on the surface.

The present application further provides compositions, comprising:

i) 1,2-dichloro-1,2-difluoroethylene; and ii) a compound selected from HFE-7000 and tetrahydrofuran.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

All figures represent a plot of percent difference in dew point pressure and bubble point pressure as a function of mole fraction of CFO-1112. The solid lines indicate that those compositions exhibit percent pressure difference of less than 5%. The dashed lines indicate those compositions that exhibit greater than 5% difference.

DETAILED DESCRIPTION

Figure 1:
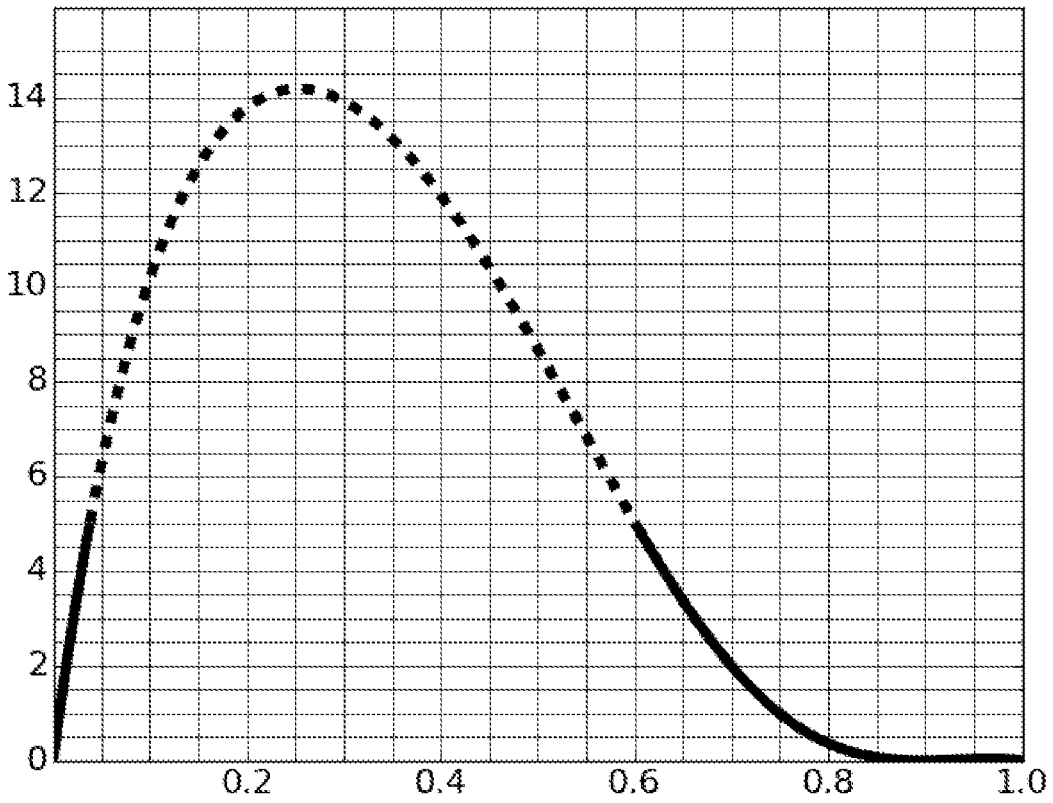
FIG. 1 shows azeotrope-like ranges calculated for the binary mixture of 1,2-dichloro-1,2-difluoroethylene and n-pentane at 20.5° C.

The present disclosure provides compositions comprising 1,2-dichloro-1,2-difluoroethylene and, optionally, one or more additional component, which may be useful in one or more of the cleaning, solvent, carrier fluid, and deposition applications as described herein.

Definitions and Abbreviations

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

As used herein, the term "consisting essentially of" is used to define a composition, method that includes materials, steps, features, components, or elements, in addition to those literally disclosed provided that these additional included materials, steps, features, components, or elements do not materially affect the basic and novel characteristic(s) of the claimed invention, especially the mode of action to achieve the desired result of any of the processes of the present invention. The term "consists essentially of" or "consisting essentially of" occupies a middle ground between "comprising" and "consisting of".

Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

As used herein, the term "about" is meant to account for variations due to experimental error (e.g., plus or minus approximately 10% of the indicated value). All measurements reported herein are understood to be modified by the term "about", whether or not the term is explicitly used, unless explicitly stated otherwise.

As recognized in the art, an azeotropic composition is an admixture of two or more different components which, when in liquid form and (1a) under a given constant pressure, will boil at a substantially constant temperature, which temperature may be higher or lower than the boiling temperatures of the individual components, or (1b) at a given constant temperature, will boil at a substantially constant pressure, which pressure may be higher or lower than the boiling pressure of the individual components, and (2) will boil at substantially constant composition, which phase compositions, while constant, are not necessarily equal. (See, e.g., M. F. Doherty and M.F. Malone, Conceptual Design of Distillation Systems, McGraw-Hill (New York), 2001, 185).

A homogeneous azeotrope, in which a single vapor phase is in equilibrium with a single liquid phase, has, in addition to properties (1a), (1b), and (2) above, the composition of each component is the same in each of the coexisting equilibrium phases. The general term "azeotrope" is a commonly used alternative name for a homogeneous azeotrope.

As used herein, an "azeotrope-like" composition refers to a composition that behaves like an azeotropic composition (i.e., has constant boiling characteristics or a tendency not to fractionate upon boiling or evaporation). Hence, during boiling or evaporation, the vapor and liquid compositions, if they change at all, change only to a minimal or negligible extent. In contrast, the vapor and liquid compositions of non-azeotrope-like compositions change to a substantial degree during boiling or evaporation.

As used herein, the terms "azeotrope-like" or "azeotrope-like behavior" refer to compositions that exhibit dew point pressure and bubble point pressure with virtually no pressure differential. In some embodiments, the difference in the dew point pressure and bubble point pressure at a given temperature is 5% or less.

When an amount, concentration, or other value or parameter is given as either a range, preferred range or a list of upper preferable values and/or lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range.

Chemicals, Abbreviations, and Acronyms

CFO-1112: 1,2-dichloro-1,2-difluoroethylene (mixture of isomers)

CFO-1112(E) or CFO-1112E: E-1,2-dichloro-1,2-difluoroethylene

CFO-1112(Z) or CFO-1112Z: Z-1,2-dichloro-1,2-difluoroethylene

R-1336mzzZ or HFO-1336mzz(Z) or (Z)-1336mzz: (Z)-1,1,1,4,4,4-hexafluorobut-2-ene HFE-7000: 1,1,1,2,2,3,3-heptafluoro-3-methoxypropane R-1233xfB: 2-bromo-3,3,3-trifluoropropene R-1345mzzE: (E)-1,1,1,4,4-pentafluoro-2-butene R-43-10mee: 1,1,1,2,2,3,4,5,5,5-decafluoropentane R-365mfc: 1,1,1,3,3-pentafluorobutane R-153-10mzzy: 1,1,1,4,5,5,5-heptafluoro-4-(trifluoromethyl)-2-pentene Compositions In some embodiments, the present application provides a composition comprising:

i) 1,2-dichloro-1,2-difluoroethylene; and, optionally, ii) a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy.

In some embodiments, the composition provided herein is an azeotrope or azeotrope-like composition. In some embodiments, the composition provided herein is an azeotrope composition. In some embodiments, the composition provided herein is an azeotrope-like composition. In some embodiments, the compound selected from N-pentane, HFE-7000, R-1233xfB, R-1336mzzZ, dimethoxymethane, R-1345mzzE, R-43-10mee, R-365mfc, tetrahydrofuran, and R-153-10mzzy is present in the composition in an amount effect to form an azeotrope or azeotrope-like composition with the 1,2-dichloro-1,2-difluoroethylene.

In some embodiments, the composition comprises 1,2-dichloro-1,2-difluoroethylene. In some embodiments, the composition provided herein comprises about 1 to about 99 weight percent 1,2-dichloro-1,2-difluoroethylene.

In some embodiments, the composition comprises:

i) 1,2-dichloro-1,2-difluoroethylene; and ii) a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy.

In some embodiments, the composition comprises:

i) 1,2-dichloro-1,2-difluoroethylene; and ii) a compound selected from HFE-7000 and tetrahydrofuran.

In some embodiments, the 1,2-dichloro-1,2-difluoroethylene comprises a mixture of (E)-1,2-dichloro-1,2-difluoroethylene and (Z)-1,2-dichloro-1,2-difluoroethylene.

In some embodiments, the 1,2-dichloro-1,2-difluoroethylene comprises about 60% to about 70% E-1,2-dichloro-1,2-difluoroethylene and about 30% to about 40% Z-1,2-dichloro-1,2-difluoroethylene.

In some embodiments, the 1,2-dichloro-1,2-difluoroethylene comprises about 60% E-1,2-dichloro-1,2-difluoroethylene and about 40% Z-1,2-dichloro-1,2-difluoroethylene. In some embodiments, the 1,2-dichloro-1,2-difluoroethylene comprises about 70% E-1,2-dichloro-1,2-difluoroethylene and about 30% Z-1,2-dichloro-1,2-difluoroethylene.

In some embodiments, the composition provided herein comprises about 1 to about 99 weight percent 1,2-dichloro-1,2-difluoroethylene and about 99 to about 1 weight percent of a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy.

In some embodiments, the composition comprises 1,2-dichloro-1,2-difluoroethylene and n-pentane. In some embodiments, the composition comprising 1,2-dichloro-1,2-difluoroethylene and n-pentane is an azeotrope or azeotrope-like composition. In some embodiments, the composition comprising 1,2-dichloro-1,2-difluoroethylene and n-pentane is an azeotrope composition. In some embodiments, the composition comprising 1,2-dichloro-1,2-difluoroethylene and n-pentane is an azeotrope-like composition.

In some embodiments, the composition comprising 1,2-dichloro-1,2-difluoroethylene and n-pentane is an azeotrope or azeotrope-like composition at a temperature of about 20° C. to about 23° C. at a pressure of about 101 kPa. In some embodiments, the composition comprising 1,2-dichloro-1,2-difluoroethylene and n-pentane is an azeotrope composition at a temperature of about 20° C. to about 21° C. at a pressure of about 101 kPa.

In some embodiments, the composition provided herein comprises about 1 to about 99 weight percent 1,2-dichloro-1,2-difluoroethylene and about 99 to about 1 weight percent n-pentane. In some embodiments, the composition provided herein comprises about 75 to about 99 weight percent 1,2-dichloro-1,2-difluoroethylene and about 25 to about 1 weight percent n-pentane. In some embodiments, the composition provided herein comprises about 75 to about 95 weight percent 1,2-dichloro-1,2-difluoroethylene and about 25 to about 5 weight percent n-pentane. In some embodiments, the composition provided herein comprises about 94 weight percent 1,2-dichloro-1,2-difluoroethylene and 6 weight percent n-pentane. In some embodiments, the composition consists essentially of 1,2-dichloro-1,2-difluoroethylene and n-pentane. In some embodiments, the composition consists of 1,2-dichloro-1,2-difluoroethylene and n-pentane.

In some embodiments, the composition comprises 1,2-dichloro-1,2-difluoroethylene and HFE-7000. In some embodiments, the composition comprising 1,2-dichloro-1,2-difluoroethylene and HFE-7000 is an azeotrope or azeotrope-like composition. In some embodiments, the composition comprising 1,2-dichloro-1,2-difluoroethylene and HFE-7000 is an azeotrope composition. In some embodiments, the composition comprising 1,2-dichloro-1,2-difluoroethylene and HFE-7000 is an azeotrope-like composition.

In some embodiments, the composition comprising 1,2-dichloro-1,2-difluoroethylene and HFE-7000 is an azeotrope or azeotrope-like composition at a temperature of about 20° C. to about 25° C. at a pressure of about 101 kPa. In some embodiments, the composition comprising 1,2-dichloro-1,2-difluoroethylene and HFE-7000 is an azeotrope composition at a temperature of about 20° C. to about 21° C. at a pressure of about 101 kPa.

In some embodiments, the composition provided herein comprises about 1 to about 99 weight percent 1,2-dichloro-1,2-difluoroethylene and about 99 to about 1 weight percent HFE-7000. In some embodiments, the composition provided herein comprises about 54 to about 99 weight percent 1,2-dichloro-1,2-difluoroethylene and about 46 to about 1 weight percent HFE-7000. In some embodiments, the composition provided herein comprises about 54 to about 86 weight percent 1,2-dichloro-1,2-difluoroethylene and about 46 to about 14 weight percent HFE-7000. In some embodiments, the composition provided herein comprises about 86 weight percent 1,2-dichloro-1,2-difluoroethylene and 14 weight percent HFE-7000. In some embodiments, the composition consists essentially of 1,2-dichloro-1,2-difluoroethylene and HFE-7000. In some embodiments, the composition consists of 1,2-dichloro-1,2-difluoroethylene and HFE-7000.

In some embodiments, the composition comprises 1,2-dichloro-1,2-difluoroethylene and R-1233xfB. In some embodiments, the composition comprising 1,2-dichloro-1,2-difluoroethylene and R-1233xfB is an azeotrope or azeotrope-like composition. In some embodiments, the composition comprising 1,2-dichloro-1,2-difluoroethylene and R-1233xfB is an azeotrope composition. In some embodiments, the composition comprising 1,2-dichloro-1,2-difluoroethylene and R-1233xfB is an azeotrope-like composition.

In some embodiments, the composition comprising 1,2-dichloro-1,2-difluoroethylene and R-1233xfB is an azeotrope or azeotrope-like composition at a temperature of about 20° C. to about 23° C. at a pressure of about 101 kPa. In some embodiments, the composition comprising 1,2-dichloro-1,2-difluoroethylene and R-1233xfB is an azeotrope composition at a temperature of about 20° C. to about 21° C. at a pressure of about 101 kPa.

In some embodiments, the composition provided herein comprises about 1 to about 99 weight percent 1,2-dichloro-1,2-difluoroethylene and about 99 to about 1 weight percent R-1233xfB. In some embodiments, the composition provided herein comprises about 62 to about 99 weight percent 1,2-dichloro-1,2-difluoroethylene and about 38 to about 1 weight percent R-1233xfB. In some embodiments, the composition provided herein comprises about 62 to about 91 weight percent 1,2-dichloro-1,2-difluoroethylene and about 46 to about 9 weight percent R-1233xfB. In some embodiments, the composition provided herein comprises about 91 weight percent 1,2-dichloro-1,2-difluoroethylene and 9 weight percent R-1233xfB. In some embodiments, the composition consists essentially of 1,2-dichloro-1,2-difluoroethylene and R-1233xfB. In some embodiments, the composition consists of 1,2-dichloro-1,2-difluoroethylene and R-1233xfB. In some embodiments, the composition comprises 1,2-dichloro-1,2-difluoroethylene and R-1336mzzZ. In some embodiments, the composition comprising 1,2-dichloro-1,2-difluoroethylene and R-1336mzzZ is an azeotrope or azeotrope-like composition. In some embodiments, the composition comprising 1,2-dichloro-1,2-difluoroethylene and R-1336mzzZ is an azeotrope composition. In some embodiments, the composition comprising 1,2-dichloro-1,2-difluoroethylene and R-1336mzzZ is an azeotrope-like composition.

In some embodiments, the composition comprising 1,2-dichloro-1,2-difluoroethylene and R-1336mzzZ is an azeotrope or azeotrope-like composition at a temperature of about 19° C. to about 23° C. at a pressure of about 101 kPa. In some embodiments, the composition comprising 1,2-dichloro-1,2-difluoroethylene and R-1336mzzZ is an azeotrope composition at a temperature of about 19° C. to about 20° C. at a pressure of about 101 kPa.

In some embodiments, the composition provided herein comprises about 1 to about 99 weight percent 1,2-dichloro-1,2-difluoroethylene and about 99 to about 1 weight percent R-1336mzzZ. In some embodiments, the composition provided herein comprises about 60 to about 99 weight percent 1,2-dichloro-1,2-difluoroethylene and about 38 to about 1 weight percent R-1336mzzZ. In some embodiments, the composition provided herein comprises about 60 to about 80 weight percent 1,2-dichloro-1,2-difluoroethylene and about 40 to about 20 weight percent R-1336mzzZ. In some embodiments, the composition provided herein comprises about 80 weight percent 1,2-dichloro-1,2-difluoroethylene and 20 weight percent R-1336mzzZ. In some embodiments, the composition consists essentially of 1,2-dichloro-1,2-difluoroethylene and R-1336mzzZ. In some embodiments, the composition consists of 1,2-dichloro-1,2-difluoroethylene and R-1336mzzZ.

In some embodiments, the composition comprises 1,2-dichloro-1,2-difluoroethylene and dimethoxymethane. In some embodiments, the composition comprising 1,2-dichloro-1,2-difluoroethylene and dimethoxymethane is an azeotrope or azeotrope-like composition. In some embodiments, the composition comprising 1,2-dichloro-1,2-difluoroethylene and dimethoxymethane is an azeotrope composition. In some embodiments, the composition comprising 1,2-dichloro-1,2-difluoroethylene and dimethoxymethane is an azeotrope-like composition.

In some embodiments, the composition comprising 1,2-dichloro-1,2-difluoroethylene and dimethoxymethane is an azeotrope or azeotrope-like composition at a temperature of about 39° C. to about 43° C. at a pressure of about 101 kPa. In some embodiments, the composition comprising 1,2-dichloro-1,2-difluoroethylene and dimethoxymethane is an azeotrope composition at a temperature of about 42° C. to about 43° C. at a pressure of about 101 kPa.

In some embodiments, the composition provided herein comprises about 1 to about 99 weight percent 1,2-dichloro-1,2-difluoroethylene and about 99 to about 1 weight percent dimethoxymethane. In some embodiments, the composition provided herein comprises about 1 to about 35 weight percent 1,2-dichloro-1,2-difluoroethylene and about 99 to about 65 weight percent dimethoxymethane. In some embodiments, the composition provided herein comprises about 6 to about 35 weight percent 1,2-dichloro-1,2-difluoroethylene and about 94 to about 65 weight percent dimethoxymethane. In some embodiments, the composition provided herein comprises about 7 weight percent 1,2-dichloro-1,2-difluoroethylene and 93 weight percent dimethoxymethane. In some embodiments, the composition consists essentially of 1,2-dichloro-1,2-difluoroethylene and dimethoxymethane. In some embodiments, the composition consists of 1,2-dichloro-1,2-difluoroethylene and dimethoxymethane.

In some embodiments, the composition comprises 1,2-dichloro-1,2-difluoroethylene and R-1345mzzE. In some embodiments, the composition comprising 1,2-dichloro-1,2-difluoroethylene and R-1345mzzE is an azeotrope or azeotrope-like composition. In some embodiments, the composition comprising 1,2-dichloro-1,2-difluoroethylene and R-1345mzzE is an azeotrope composition. In some embodiments, the composition comprising 1,2-dichloro-1,2-difluoroethylene and R-1345mzzE is an azeotrope-like composition.

In some embodiments, the composition comprising 1,2-dichloro-1,2-difluoroethylene and R-1345mzzE is an azeotrope or azeotrope-like composition at a temperature of about 20° C. to about 24° C. at a pressure of about 101 kPa. In some embodiments, the composition comprising 1,2-dichloro-1,2-difluoroethylene and R-1345mzzE is an azeotrope composition at a temperature of about 20° C. to about 21° C. at a pressure of about 101 kPa.

In some embodiments, the composition provided herein comprises about 1 to about 99 weight percent 1,2-dichloro-1,2-difluoroethylene and about 99 to about 1 weight percent R-1345mzzE. In some embodiments, the composition provided herein comprises about 95 to about 60 weight percent 1,2-dichloro-1,2-difluoroethylene and about 5 to about 40 weight percent R-1345mzzE. In some embodiments, the composition provided herein comprises about 93 to about 62 weight percent 1,2-dichloro-1,2-difluoroethylene and about 7 to about 38 weight percent R-1345mzzE. In some embodiments, the composition provided herein comprises about 93 weight percent 1,2-dichloro-1,2-difluoroethylene and 7 weight percent R-1345mzzE. In some embodiments, the composition consists essentially of 1,2-dichloro-1,2-difluoroethylene and R-1345mzzE. In some embodiments, the composition consists of 1,2-dichloro-1,2-difluoroethylene and R-1345mzzE.

In some embodiments, the composition comprises 1,2-dichloro-1,2-difluoroethylene and R-43-10mee. In some embodiments, the composition comprising 1,2-dichloro-1,2-difluoroethylene and R-43-10mee is an azeotrope or azeotrope-like composition. In some embodiments, the composition comprising 1,2-dichloro-1,2-difluoroethylene and R-43-10mee is an azeotrope-like composition. In some embodiments, the composition comprising 1,2-dichloro-1,2-difluoroethylene and R-43-10mee is an azeotrope or azeotrope-like composition at a temperature of about 20° C. to about 23° C. at a pressure of about 101 kPa.

In some embodiments, the composition provided herein comprises about 1 to about 99 weight percent 1,2-dichloro-1,2-difluoroethylene and about 99 to about 1 weight percent R-43-10mee. In some embodiments, the composition provided herein comprises about 89 to about 99 weight percent 1,2-dichloro-1,2-difluoroethylene and about 11 to about 1 weight percent R-43-10mee. In some embodiments, the composition provided herein comprises about 89 to about 95 weight percent 1,2-dichloro-1,2-difluoroethylene and about 11 to about 5 weight percent R-43-10mee. In some embodiments, the composition provided herein comprises about 90 weight percent 1,2-dichloro-1,2-difluoroethylene and about 10 weight percent R-43-10mee. In some embodiments, the composition consists essentially of 1,2-dichloro-1,2-difluoroethylene and R-43-10mee. In some embodiments, the composition consists of 1,2-dichloro-1,2-difluoroethylene and R-43-10mee.

In some embodiments, the composition comprises 1,2-dichloro-1,2-difluoroethylene and R-365mfc. In some embodiments, the composition comprising 1,2-dichloro-1,2-difluoroethylene and R-365mfc is an azeotrope or azeotrope-like composition. In some embodiments, the composition comprising 1,2-dichloro-1,2-difluoroethylene and R-365mfc is an azeotrope-like composition. In some embodiments, the composition comprising 1,2-dichloro-1,2-difluoroethylene and R-365mfc is an azeotrope or azeotrope-like composition at a temperature of about 20° C. to about 24° C. at a pressure of about 101 kPa.

In some embodiments, the composition provided herein comprises about 1 to about 99 weight percent 1,2-dichloro-1,2-difluoroethylene and about 99 to about 1 weight percent R-365mfc. In some embodiments, the composition provided herein comprises about 76 to about 99 weight percent 1,2-dichloro-1,2-difluoroethylene and about 24 to about 1 weight percent R-365mfc. In some embodiments, the composition provided herein comprises about 76 to about 95 weight percent 1,2-dichloro-1,2-difluoroethylene and about 24 to about 5 weight percent R-365mfc. In some embodiments, the composition provided herein comprises about 76 to about 84 weight percent 1,2-dichloro-1,2-difluoroethylene and about 24 to about 16 weight percent R-365mfc. In some embodiments, the composition provided herein comprises about 80 weight percent 1,2-dichloro-1,2-difluoroethylene and about 20 weight percent R-365mfc. In some embodiments, the composition consists essentially of 1,2-dichloro-1,2-difluoroethylene and R-365mfc. In some embodiments, the composition consists of 1,2-dichloro-1,2-difluoroethylene and R-365mfc.

In some embodiments, the composition comprises 1,2-dichloro-1,2-difluoroethylene and tetrahydrofuran. In some embodiments, the composition comprising 1,2-dichloro-1,2-difluoroethylene and tetrahydrofuran is an azeotrope or azeotrope-like composition. In some embodiments, the composition comprising 1,2-dichloro-1,2-difluoroethylene and tetrahydrofuran is an azeotrope-like composition. In some embodiments, the composition comprising 1,2-dichloro-1,2-difluoroethylene and tetrahydrofuran is an azeotrope or azeotrope-like composition at a temperature of about 59° C. to about 66° C. at a pressure of about 101 kPa.

In some embodiments, the composition provided herein comprises about 1 to about 99 weight percent 1,2-dichloro-1,2-difluoroethylene and about 99 to about 1 weight percent tetrahydrofuran. In some embodiments, the composition provided herein comprises about 1 to about 22 weight percent 1,2-dichloro-1,2-difluoroethylene and about 99 to about 78 weight percent tetrahydrofuran. In some embodiments, the composition provided herein comprises about 5 to about 22 weight percent 1,2-dichloro-1,2-difluoroethylene and about 95 to about 78 weight percent tetrahydrofuran. In some embodiments, the composition consists essentially of 1,2-dichloro-1,2-difluoroethylene and tetrahydrofuran. In some embodiments, the composition consists of 1,2-dichloro-1,2-difluoroethylene and tetrahydrofuran.

In some embodiments, the composition comprises 1,2-dichloro-1,2-difluoroethylene and R-153-10mzzy. In some embodiments, the composition comprising 1,2-dichloro-1,2-difluoroethylene and R-153-10mzzy is an azeotrope or azeotrope-like composition. In some embodiments, the composition comprising 1,2-dichloro-1,2-difluoroethylene and R-153-10mzzy is an azeotrope-like composition. In some embodiments, the composition comprising 1,2-dichloro-1,2-difluoroethylene and R-153-10mzzy is an azeotrope or azeotrope-like composition at a temperature of about 20° C. to about 23° C. at a pressure of about 101 kPa.

In some embodiments, the composition provided herein comprises about 1 to about 99 weight percent 1,2-dichloro-1,2-difluoroethylene and about 99 to about 1 weight percent R-153-10mzzy. In some embodiments, the composition provided herein comprises about 87 to about 99 weight percent 1,2-dichloro-1,2-difluoroethylene and about 13 to about 1 weight percent R-153-10mzzy. In some embodiments, the composition provided herein comprises about 87 to about 95 weight percent 1,2-dichloro-1,2-difluoroethylene and about 13 to about 5 weight percent R-153-10mzzy. In some embodiments, the composition provided herein comprises about 90 weight percent 1,2-dichloro-1,2-difluoroethylene and about 10 weight percent R-153-10mzzy. In some embodiments, the composition consists essentially of 1,2-dichloro-1,2-difluoroethylene and R-153-10mzzy. In some embodiments, the composition consists of 1,2-dichloro-1,2-difluoroethylene and R-153-10mzzy.

Methods of Use

In some embodiments, compositions described herein are useful as cleaning agents, defluxing agents, and/or degreasing agents. Accordingly, the present application provides a process of cleaning a surface, comprising contacting a composition provided herein with said surface. In some embodiments, the process comprises removing a residue from a surface or substrate, comprising contacting the surface or substrate with a composition provided herein and recovering the surface or substrate from the composition.

100651 In some embodiments, the present application further provides a process for dissolving a solute, comprising contacting and mixing said solute with a sufficient quantity of a composition provided herein.

In some embodiments, the surface or substrate may be an integrated circuit device, in which case, the residue comprises rosin flux or oil. The integrated circuit device may be a circuit board with various types of components, such as Flip chips, μBGAs, or Chip scale packaging components. The surface or substrate may additionally be a metal surface such as stainless steel. The rosin flux may be any type commonly used in the soldering of integrated circuit devices, including but not limited to RMA (rosin mildly activated), RA (rosin activated), WS (water soluble), and OA (organic acid). Oil residues include but are not limited to mineral oils, motor oils, and silicone oils.

In some embodiments, the present application provides a process for removing at least a portion of water from the surface of a wetted substrate, or surface, or device, comprising contacting the substrate, surface, or device with a composition provided herein, and then removing the substrate, surface, or device from contact with the composition.

In some embodiments, the composition provided herein further comprises at least one surfactant suitable for dewatering or drying the substrate. Exemplary surfactants include, but are not limited to, alkyl dimethyl ammonium isooctyl phosphates, tert-alkyl amines (e.g., tert-butyl amine), perfluoro alkyl phosphates, dimethyl decenamide, fluorinated alkyl polyether, quaternary amines (e.g., ammonium salts), and glycerol monostearate.

The means for contacting a device, surface, or substrate is not critical and may be accomplished, for example, by immersion of the device, surface, or substrate, in a bath containing the composition provided herein, spraying the device, surface, or substrate with the composition provided herein, or wiping the device, surface, or substrate with a material (e.g., a cloth) that has been wet with the composition. Alternatively, a composition provided herein may also be used in a vapor degreasing or defluxing apparatus designed for such residue removal. Such vapor degreasing or defluxing equipment is available from various suppliers such as Forward Technology (a subsidiary of the Crest Group, Trenton, N.J.), Trek Industries (Azusa, Calif.), and Ultronix, Inc. (Hatfield, Pa.) among others.

The most advanced, highest recording densities and lowest cost method of storing digital information involves writing and reading magnetic flux patterns from rotating disks coated with magnetic materials. A magnetic layer, where information is stored in the form of bits, is sputtered onto a metallic support structure. Next an overcoat, usually a carbon-based material, is placed on top of the magnetic layer for protection and finally a lubricant is applied to the overcoat. A read-write head flies above the lubricant and the information is exchanged between the head and the magnetic layer. In a relentless attempt to increase the efficiency of information transfer, hard drive manufacturers have reduced the distance between the head and the magnetic layer, or fly-height, to less than 100 Angstroms.

Invariably, during normal disk drive application, the head and the disk surface will make contact. To reduce wear on the disk, from both sliding and flying contacts, it must be lubricated.

Fluorolubricants are widely used as lubricants in the magnetic disk drive industry to decrease the friction between the head and disk, that is, reduce the wear and therefore minimize the possibility of disk failure.

There is a need in the industry for improved methods for deposition of fluorolubricants. The use of certain solvents, such as CFC-113 and PFC-5060, has been regulated due to their impact on the environment. Therefore, solvents that will be used in this application should consider environmental impact. Also, such solvent must dissolve the fluorolubricant and form a substantially uniform or uniform coating of fluorolubricant. Additionally, existing solvents have been found to require higher fluorolubricant concentrations to produce a given thickness coating and produce irregularities in uniformity of the fluorolubricant coating.

In some embodiments, the fluorolubricants of the present disclosure comprise perfluoropolyether (PFPE) compounds, or lubricant comprising X-1P®, which is a phosphazene-containing disk lubricant. These perfluoropolyether compounds are sometimes referred to as perfluoroalkylethers (PFAE) or perfluoropolyalkylethers (PFPAE). These PFPE compounds range from simple perfluorinated ether polymers to functionalized perfluorinated ether polymers. PFPE compounds of different varieties that may be useful as fluorolubricant in the present invention are available from several sources. In some embodiments, fluorolubricants useful in the processes provided herein include, but are not limited to, Krytox® GLP 100, GLP 105 or GLP 160 (The Chemours Co., LLC, Fluoroproducts, Wilmington, Del., 19898, USA); Fomblin® Z-Dol 2000, 2500 or 4000, Z-Tetraol, or Fomblin® AM 2001 or AM 3001 (sold by Solvay Solexis S.p.A., Milan, Italy); Demnum™ LR-200 or S-65 (offered by Daikin America, Inc., Osaka, Japan); X-1P® (a partially fluorinated hyxaphenoxy cyclotriphosphazene disk lubricant available from Quixtor Technologies Corporation, a subsidiary of Dow Chemical Co, Midland, Mich.); and mixtures thereof. The Krytox® lubricants are perfluoroalkylpolyethers having the general structure $F(CF(CF_3)CF_2O)_n—CF_2CF_3$, wherein n ranges from 10 to 60. The Fomblin® lubricants are functionalized perfluoropolyethers that range in molecular weight from 500 to 4000 atomic mass units and have general formula $X—CF_2—O(CF_2—CF_2—O)_p—(CF_2O)_q—CF_2—X$, wherein X may be $—CH_2OH$, p+q is 40 to 180, and p/q is 0.5 to 2; $CH_2(O—CH_2—CH_2)_nOH$, wherein n is 10 to 60, $CH_2OCH_2CH(OH)CH_2OH$, or $—CH_2O—CH_2$-piperonyl. The Demnum™ oils are perfluoropolyether-based oils ranging in molecular weight from 2700 to 8400 atomic mass units. Additionally, new lubricants are being developed such as those from Moresco (Thailand) Co., Ltd, which may be useful in processes provided herein.

The fluorolubricants described herein may additionally comprise additives to improve the properties of the fluorolubricant. X-1P®, which may serve as the lubricant itself, is often added to other lower cost fluorolubricants in order to increase the durability of disk drives by passivating Lewis acid sites on the disk surface responsible for PFPE degradation. Other common lubricant additives may be used in the fluorolubricants useful in the processes provided herein.

The fluorolubricants described herein may further comprise Z-DPA (Hitachi Global Storage Technologies, San Jose, Calif.), a PFPE terminated with dialkylamine end-groups. The nucleophilic end-groups serve the same purpose as X1P®, thus providing the same stability without any additive.

The surface on which the fluorolubricant may be deposited is any solid surface that may benefit from lubrication. Semiconductor materials such as silica disks, metal or metal oxide surfaces, vapor deposited carbon surfaces or glass surfaces are representative of the types of surfaces that may be used in the processes described herein. In some embodiments, the processes provided herein are particularly useful in coating magnetic media such as computer drive hard disks. In the manufacture of computer disks, the surface may be a glass, or aluminum substrate with layers of magnetic media that is also coated by vapor deposition with a thin (10-50 Angstrom) layer of amorphous hydrogenated or nitrogenated carbon. The fluorolubricant may be deposited on the surface disk indirectly by applying the fluorolubricant to the carbon layer of the disk.

The first step of combining the fluorolubricant and composition provided herein (i.e., as a solvent) may be accomplished in any suitable manner such as mixing in a suitable container such as a beaker or other container that may be used as a bath for the deposition process. The fluorolubricant concentration in the composition provided herein may be from about 0.010 percent (wt/wt) to about 0.50 percent (wt/wt).

The step of contacting said combination of fluorolubricant and composition provided herein with the surface may be accomplished in any manner appropriate for said surface (considering the size and shape of the surface). A hard drive disk must be supported in some manner such as with a mandrel or some other support that may fit through the hole in the center of the disk. The disk will thus be held vertically such that the plane of the disk is perpendicular to the solvent bath. The mandrel may have different shapes including but not limited to, a cylindrical bar, or a V-shaped bar. The mandrel shape will determine the area of contact with the disk. The mandrel may be constructed of any material strong enough to hold the disk, including but not limited to metal, metal alloy, plastic, or glass. Additionally, a disk may be supported vertically upright in a woven basket or be clamped into a vertical position with one or more clamps on the outer edge. The support may be constructed of any material with the strength to hold the disk, such as metal, metal alloy, plastic or glass. However the disk is supported, the disk will be lowered into a container holding a bath of the fluorolubricant/solvent (i.e., the composition provided herein) combination. The bath may be held at room temperature or be heated or cooled to temperatures ranging from about 0° C. to about 50° C.

Alternatively, the disk may be supported as described above and the bath may be raised to immerse the disk. In either case, the disk may then be removed from the bath (either by lowering the bath or by raising the disk). Excess fluorolubricant/solvent combination can be drained into the bath.

Either of the processes for contacting the fluorolubricant/solvent combination with the disk surface of either lowering the disk into a bath or raising a bath to immerse the disk are commonly referred to as dip coating. Other processes for contacting the disk with the fluorolubricant/solvent combination may be used in processes described herein, including, but not limited to, spraying or spin coating.

When the disk is removed from the bath, the disk will have a coating of fluorolubricant and some residual solvent (i.e., the composition provided herein) on its surface. The residual solvent may be evaporated. Evaporation is usually performed at room temperature. However, other temperatures both above and below room temperature may be used as well for the evaporation step. Temperatures ranging from about 0° C. to about 100° C. may be used for evaporation.

The surface, or the disk if the surface is a disk, after completion of the coating process, will be left with a substantially uniform or uniform coating of fluorolubricant that is substantially free of solvent. The fluorolubricant may be applied to a thickness of less than about 300 nm, and alternately to a thickness of about 100 to about 300 nm.

A uniform fluorolubricant coating is desired for proper functioning of a disk and so areas of varying fluorolubricant thickness are undesirable on the surface of the disk. As more and more information is being stored on the same size disk, the read/write head must get closer and closer to the disk in order to function properly. If irregularities due to variation in coating thickness are present on the surface of the disk, the probability of contact of the head with these areas on the disk is much greater. While there is a desire to have enough fluorolubricant on the disk to flow into areas where it may be removed by head contact or other means, coating that is too thick may cause "smear," a problem associated with the read/write head picking up excess fluorolubricant.

One specific coating thickness irregularity observed in the industry is that known as the "rabbit ears" effect. These irregularities are visually detected on the surface of the disk after deposition of the fluorolubricant using the existing solvent systems. When the disk is contacted with the solution of fluorolubricant in solvent and then removed from the solution, any points where the solution may accumulate and not drain readily develop drops of solution that do not readily drain off. One such point of drop formation is the contact point (or points) with the mandrel or other support device with the disk. When a V-shaped mandrel is used, there are two contact points at which the mandrel contacts the inside edge of the disk. When solution of fluorolubricant forms drops in these locations that do not drain off when removed from the bath, an area of greater thickness of fluorolubricant is created when the solvent evaporates. The two points of contact with the disk produces what is known as a "rabbit ears" effect, because the areas of greater fluorolubricant thickness produce a pattern resembling rabbit ears visually detectable on the disk surface.

When dip coating is used for depositing fluorolubricant on the surface, the pulling-up speed (speed at which the disk is removed from the bath), and the density of the fluorolubricant and the surface tension are relevant for determining the resulting film thickness of the fluorolubricant. Awareness of these parameters for obtaining the desired film thickness is required. Details on how these parameters effect coatings are given in, "Dip-Coating of Ultra-Thin Liquid Lubricant and its Control for Thin-Film Magnetic Hard Disks" in IEEE Transactions on Magnetics, vol. 31, no. 6, November 1995, the disclosure of which is incorporated herein by reference in its entirety.

EXAMPLES

The present disclosure is further defined in the following Examples. It should be understood that these Examples, while indicating preferred embodiments, are given by way of illustration only. From the above discussion and these Examples, one skilled in the art can ascertain the preferred features, and without departing from the spirit and scope thereof, can make various changes and modifications to adapt it to various uses and conditions.

Example 1

Azeotrope and Azeotrope-Like Blends of CFO-1112

Figure 2:
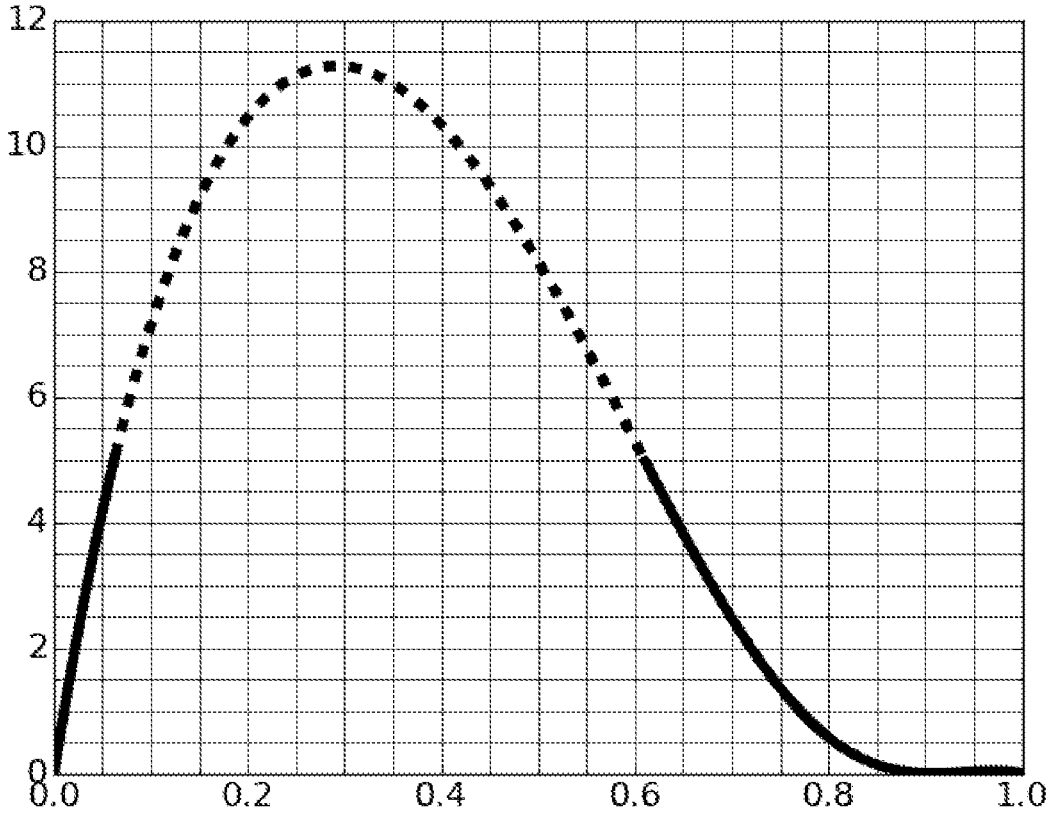
FIG. 2 shows azeotrope-like ranges calculated for the binary mixture of 1,2-dichloro-1,2-difluoroethylene and HFE-7000 at 20.5° C.
Figure 3:
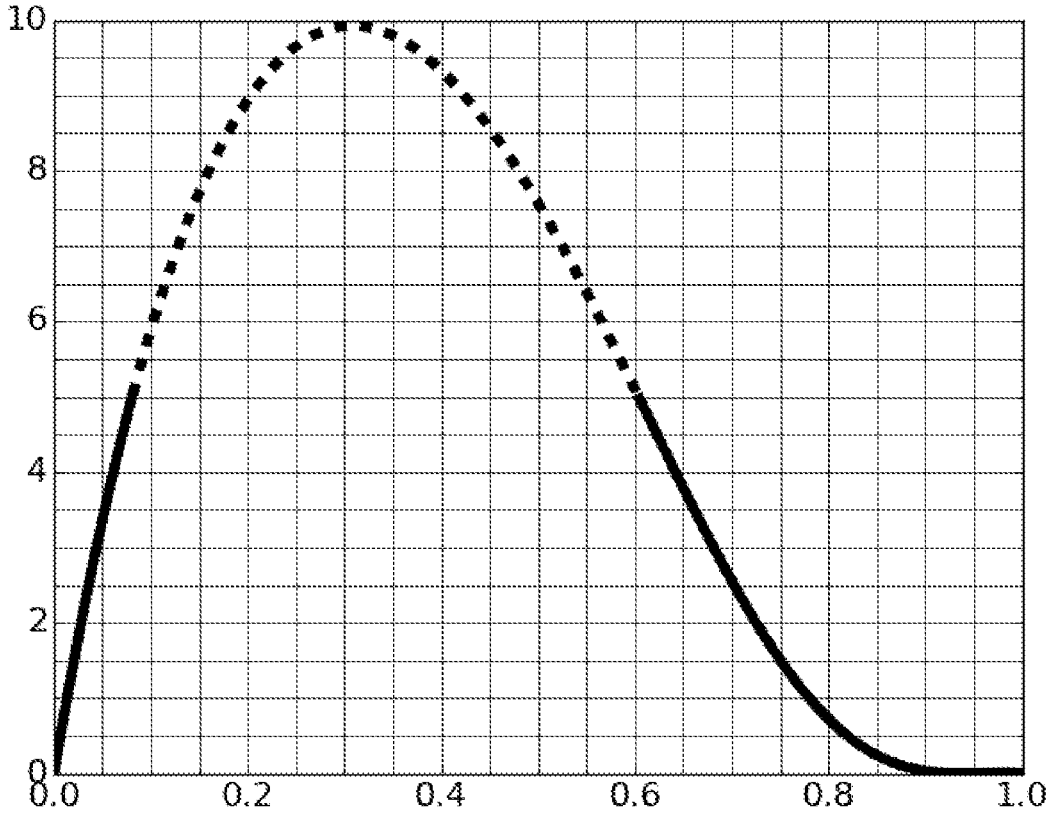
FIG. 3 shows azeotrope-like ranges calculated for the binary mixture of 1,2-dichloro-1,2-difluoroethylene and R-1233xfB at 20.5° C.
Figure 4:
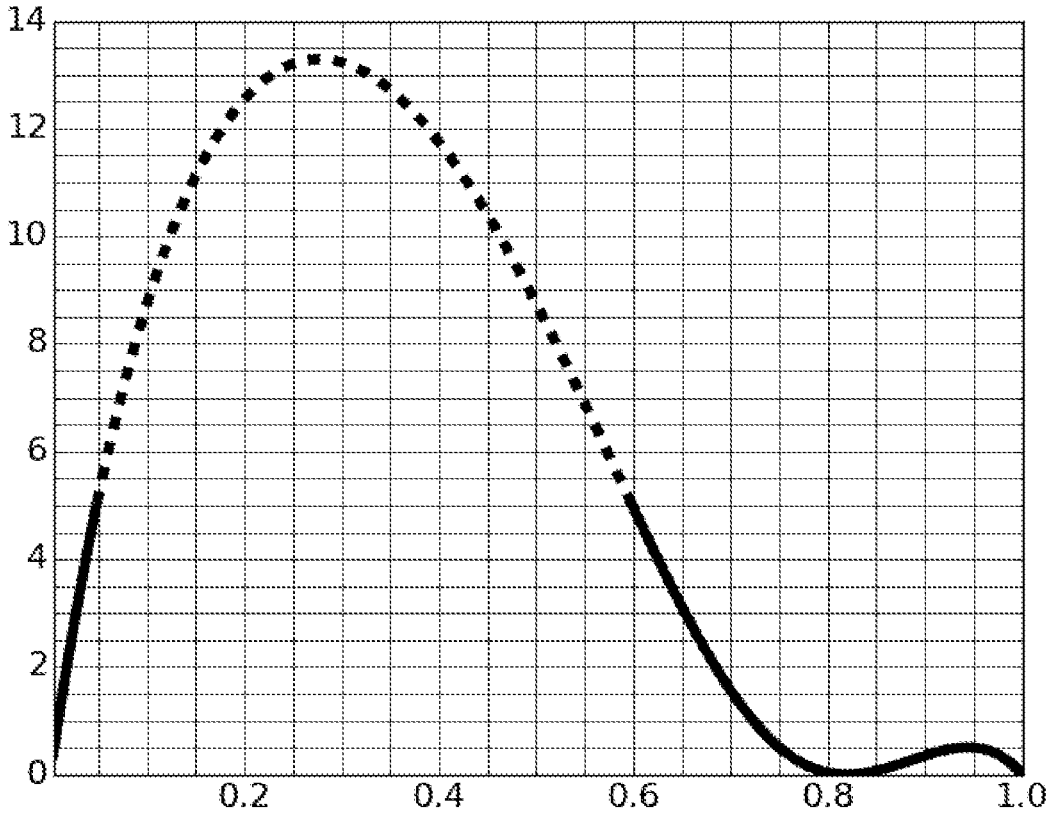
FIG. 4 shows azeotrope-like ranges calculated for the binary mixture of 1,2-dichloro-1,2-difluoroethylene and R-1336mzzZ at 19.7° C.
Figure 5:
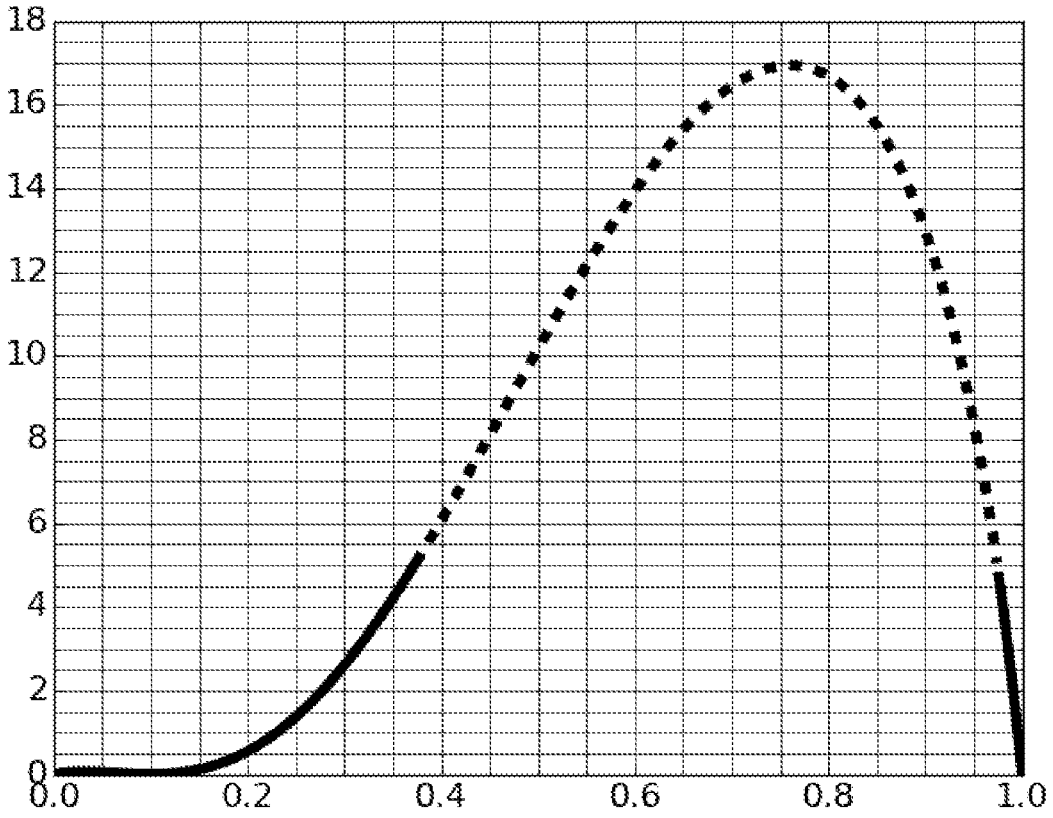
FIG. 5 shows azeotrope-like ranges calculated for the binary mixture of 1,2-dichloro-1,2-difluoroethylene and dimethoxymethane (i.e., methylal) at 42.1° C.
Figure 6:
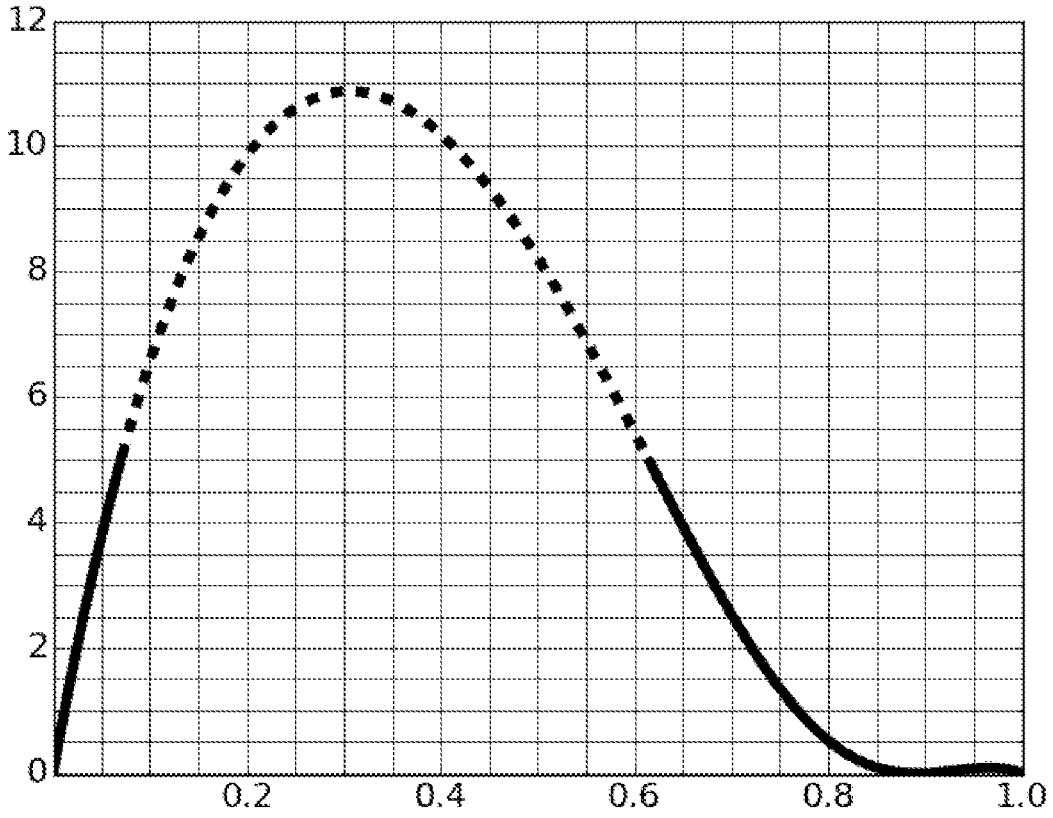
FIG. 6 shows azeotrope-like ranges calculated for the binary mixture of 1,2-dichloro-1,2-difluoroethylene and R-1345mzzE at 20.5° C.
Figure 7:
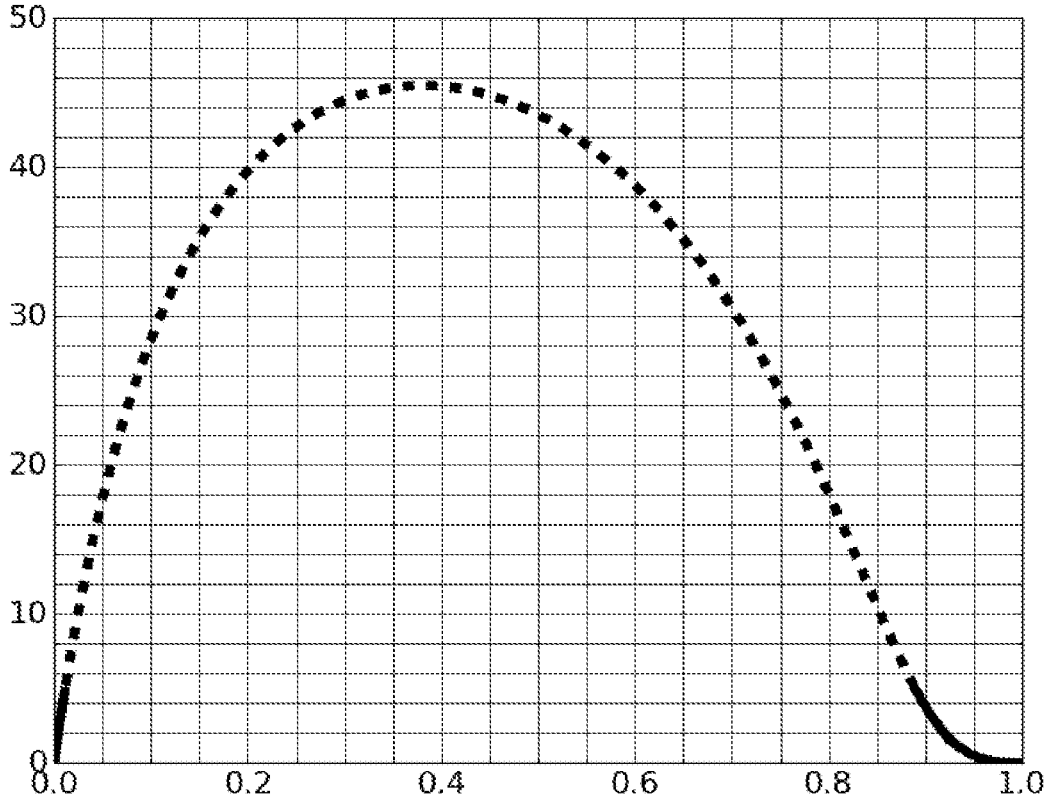
FIG. 7 shows azeotrope-like ranges calculated for the binary mixture of 1,2-dichloro-1,2-difluoroethylene and R-43-10mee at 20.8° C.
Figure 8:
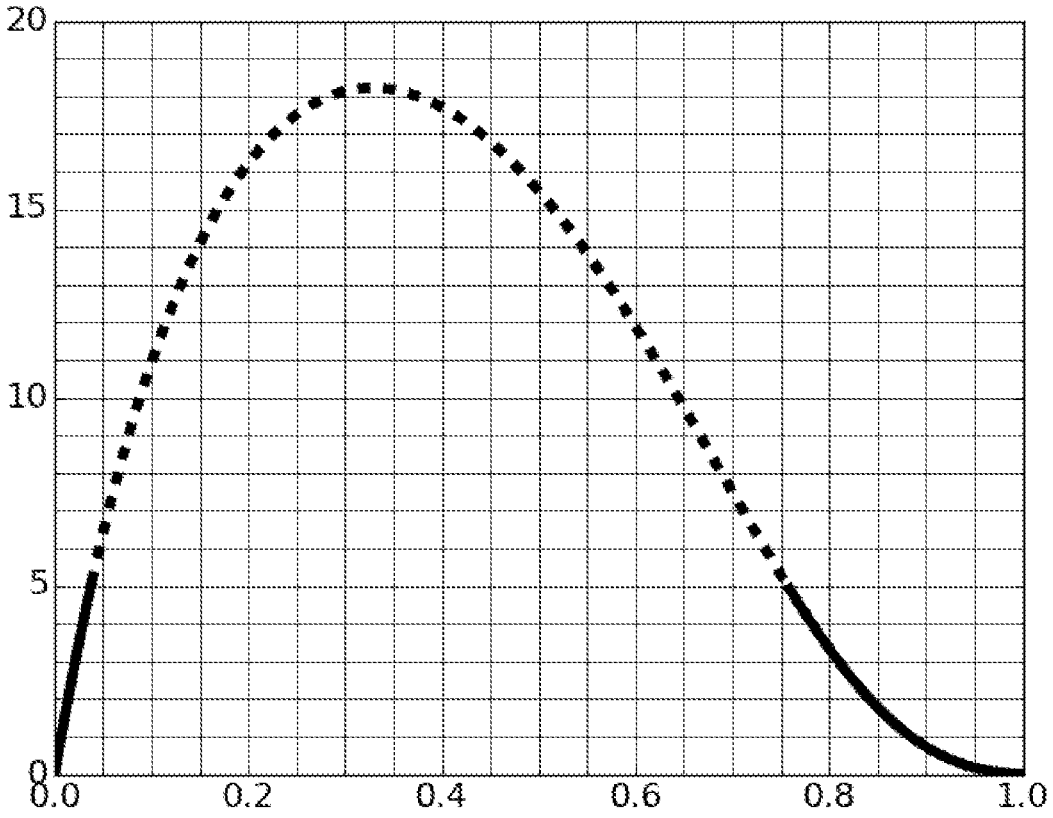
FIG. 8 shows azeotrope-like ranges calculated for the binary mixture of 1,2-dichloro-1,2-difluoroethylene and R-365mfc at 20.8° C.
Figure 9:
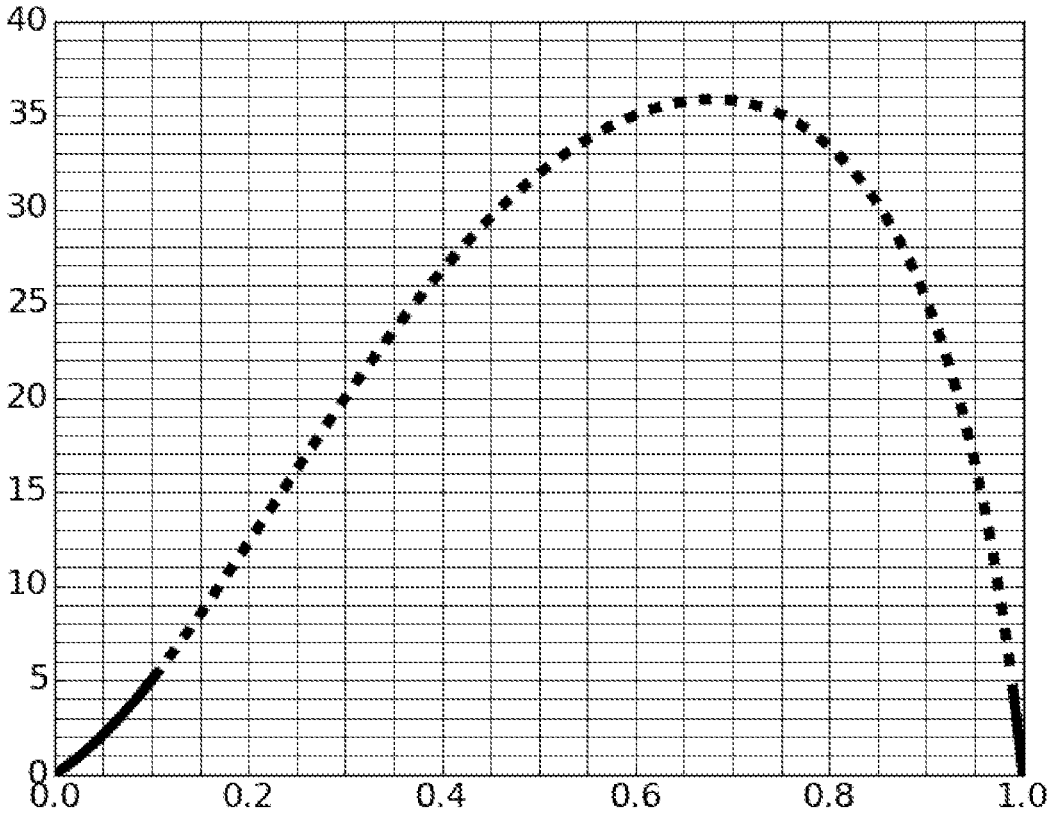
FIG. 9 shows azeotrope-like ranges calculated for the binary mixture of 1,2-dichloro-1,2-difluoroethylene and tetrahydrofuran (i.e., THF) at 66.1° C.
Figure 10:
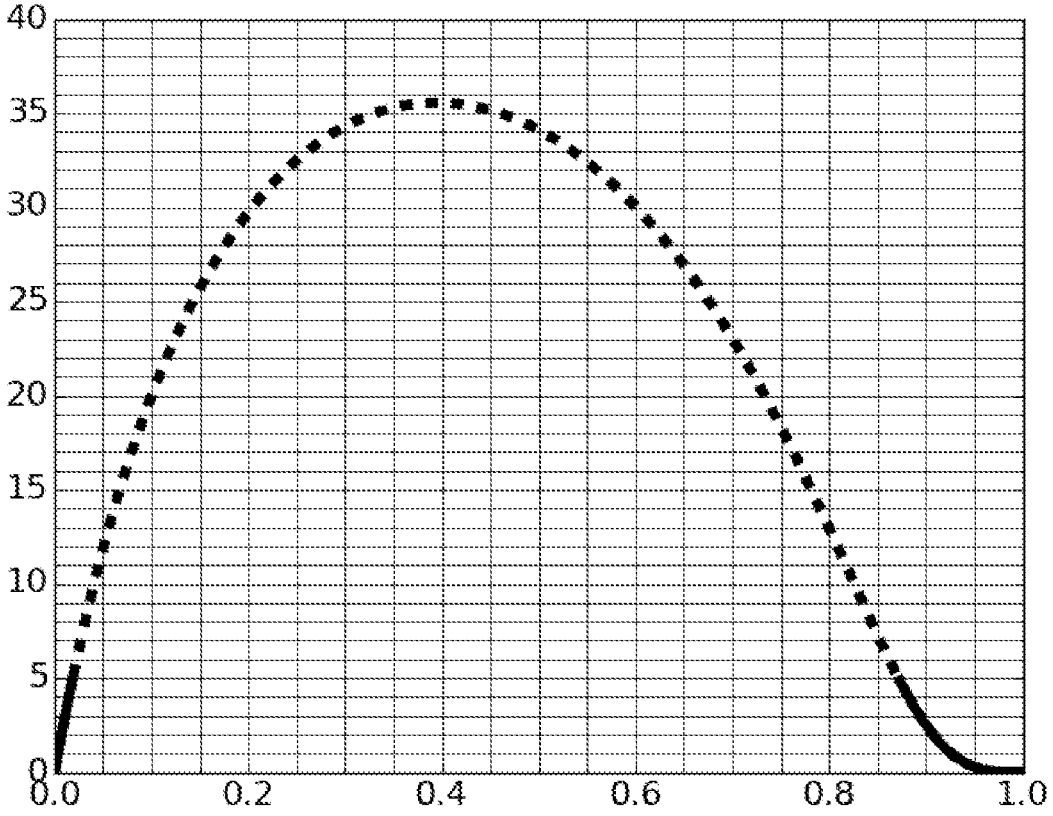
FIG. 10 shows azeotrope-like ranges calculated for the binary mixture of 1,2-dichloro-1,2-difluoroethylene and R-153-10mzzy at 20.8° C.

A UNIFAC activity coefficient model specifically for HFC and HFO fluorochemicals was regressed over VLE for 1125 binary systems. The overall absolute average deviation (AAD) of bubble and dew point data is 5.3%. Cross-validation of 81 additional binary systems resulted in a prediction accuracy of 5.1%. Furthermore, when water is excluded, the cross-validation AAD decreased to 3.7% over 74 binary systems. Additional verification was made for CFO-1112/R-1336mzzZ, where an experimentally reported an azeotrope in the range of 18 to 26 wt-% R-1336mzzZ at T=20.1° C. As shown in Table 1, the predicted azeotrope is 21 wt-% R-1336mzzZ and 19.7° C. The azeotrope and azeotrope-like data calculated for representative blends of CFO-1112 are shown below in Table 1 and in FIGS. 1-10. The azeotrope-like range is defined by those compositions for which the percent difference of dew point pressure and bubble point pressure is less than about 5% (indicated in the figures as a solid line).

TABLE 1

| Blend | Azeotrope Temperature at 101 kPa (° C.)[a] | Amount of CFO-1112 at Azeotrope Temperature, 101 kPa (wt %) | Azeotrope-Like Range (wt % CFO-1112) |
|---|---|---|---|
| CFO-1112/n-pentane | 20.5 | 93.9 | About 76 to about 99 |
| CFO-1112/HFE-7000 | 20.5 | 85.6 | About 54 to about 99 |
| CFO-1112/R-1233xfB | 20.5 | 91 | About 62 to about 99 |
| CFO-1112/R-1336mzzZ | 19.7 | 79.3 | About 60 to about 99 |
| CFO-1112/dimethoxymethane | 42.1 | 6.8 | About 1 to about 35 |
| CFO-1112/R-1345mzzE | 20.5 | 93 | About 62.6 to about 99 |

TABLE 1-continued

| Blend | Azeotrope Temperature at 101 kPa (° C.)[a] | Amount of CFO-1112 at Azeotrope Temperature, 101 kPa (wt %) | Azeotrope-Like Range (wt % CFO-1112) |
|---|---|---|---|
| CFO-1112/R-43-10mee | — | — | About 89 to about 99 |
| CFO-1112/R-365mfc | — | — | About 76 to about 99 |
| CFO-1112/tetrahydrofuran | — | — | About 1 to about 22 |
| CFO-1112/R-153-10mzzy | — | — | About 88 to about 99 |

[a]indicates that the blend did not form an azeotrope composition under test conditions

Example 2

Cleaning Effectiveness of 93.9% CFO-1112/6.1% n-Pentane Blend

A mixture of 93.9% CFO-1112/6.1% n-pentane was decanted into a 1000 mL beaker with a condensing coil and heated to the boiling point (20.5° C.) using a hot plate. Three pre-cleaned 304 stainless steel coupons were weighed on an analytical balance. A thin film of Starrett Tool and mineral oil was applied to one surface of each coupon and excess was removed with a wipe. Each coupon was then re-weighed to determine the oiled weight and amount of oil deposited. The coupons were then placed in the vapor phase of the boiling solvent blend for ten minutes. Coupons were then removed and allowed to dry and off-gas for ten minutes before reweighing to determine the cleaning effectiveness factor of the solvent blend. The cleaning effectiveness factor (CEF) was determined by Equation 1, per ASTM G-122. Results of the cleaning analysis are shown in Table 2.

$$CEF=(\text{soiled weight}-\text{post cleaned weight})/(\text{soiled weight}-\text{initial weight}) \quad (1)$$

TABLE 2

| Coupon ID | Initial Weight (g) | Oiled Weight (g) | Post-Cleaning Weight (g) | CEF (%) |
|---|---|---|---|---|
| 1A | 19.6636 | 19.6743 | 19.6637 | 99.1 |
| 1B | 19.7438 | 19.7506 | 19.7438 | 100.0 |
| 1C | 19.7783 | 19.7821 | 19.7783 | 100.0 |

Example 3

Cleaning Effectiveness of 85.6% CFO-1112 and 14.4% HFE-7000 Blend

A mixture of 85.6% CFO-1112 and 14.4% HFE-7000 was decanted into a 1000 mL beaker with a condensing coil and heated to the boiling point (20.5° C.) using a hot plate. Three pre-cleaned 304 stainless steel coupons were weighed on an analytical balance. A thin film of Krytox 240AC oil was applied to one surface of each coupon and excess was removed with a wipe. Each coupon was then re-weighed to determine the oiled weight and amount of oil deposited. The coupons were then placed in the vapor phase of the boiling solvent blend for ten minutes. Coupons were then removed and allowed to dry and off-gas for ten minutes before re-weighing to determine the cleaning effectiveness factor (CEF) of the solvent blend. The cleaning effectiveness factor (CEF) was determined by Equation 1, per ASTM G-122. Results of the cleaning analysis are shown in Table 3.

TABLE 3

| Coupon ID | Initial Weight (g) | Oiled Weight (g) | Post-Cleaning Weight (g) | CEF (%) |
|---|---|---|---|---|
| 1A | 19.7485 | 19.7542 | 19.7488 | 94.7 |
| 1B | 19.6923 | 19.7109 | 19.6929 | 96.8 |
| 1C | 19.6736 | 19.6861 | 19.6742 | 95.2 |

Example 4

Cleaning Effectiveness of 80% CFO-1112 and 20% R-1336mzzZ Blend

A mixture of 80% CFO-1112 and 20% R-1336mzzZ was decanted into a 1000 mL beaker with a condensing coil and heated to the boiling point (19.7° C.) using a hot plate. Three pre-cleaned 304 stainless steel coupons were weighed on an analytical balance. A thin film of Krytox GPL-102 oil was applied to one surface of each coupon and excess was removed with a wipe. Each coupon was then re-weighed to determine the oiled weight and amount of oil deposited. The coupons were then placed in the vapor phase of the boiling solvent blend for ten minutes. Coupons were then removed and allowed to dry and off-gas for ten minutes before re-weighing to determine the cleaning effectiveness factor of the solvent blend. The cleaning effectiveness factor (CEF) was determined by Equation 1, per ASTM G-122. Results of the cleaning analysis are shown in Table 4.

TABLE 4

| Coupon ID | Initial Weight (g) | Oiled Weight (g) | Post-Cleaning Weight (g) | CEF (%) |
|---|---|---|---|---|
| 2A | 20.0248 | 20.0537 | 20.0259 | 96.2 |
| 2B | 19.9763 | 20.0001 | 19.9771 | 96.6 |
| 2C | 20.057 | 20.1126 | 20.0576 | 98.9 |

Example 5

Cleaning Effectiveness of 7% CFO-1112 and 93% Dimethoxymethane Blend

A mixture of 7% CFO-1112 and 93% dimethoxymethane was decanted into a 1000 mL beaker with a condensing coil and heated to the boiling point (42.1° C.) using a hot plate. Three pre-cleaned 304 stainless steel coupons were weighed on an analytical balance. A thin film of Mobil 600W super cylinder oil was applied to one surface of each coupon and excess was removed with a wipe. Each coupon was then re-weighed to determine the oiled weight and amount of oil deposited. The coupons were then placed in the vapor phase of the boiling solvent blend for ten minutes. Coupons were then removed and allowed to dry and off-gas for ten minutes before re-weighing to determine the cleaning effectiveness factor of the solvent blend. The cleaning effectiveness factor (CEF) was determined by Equation 1, per ASTM G-122. Results of the cleaning analysis are shown in Table 5.

TABLE 5

| Coupon ID | Initial Weight (g) | Oiled Weight (g) | Post-Cleaning Weight (g) | CEF (%) |
|---|---|---|---|---|
| 1A | 20.0658 | 20.0757 | 20.0658 | 100.0 |
| 1B | 20.0731 | 20.0983 | 20.0726 | 102.0 |
| 1C | 20.0186 | 20.0446 | 20.0186 | 100.0 |

Example 6

Cleaning Effectiveness of 90% CFO-1112 and 10% R-43-10mee Blend

Three pre-cleaned 304 stainless steel coupons were weighed on an analytical balance. A thin film of mineral oil was applied to one surface of each coupon and excess was removed with a wipe. Each coupon was then reweighed to determine the oiled weight and amount of oil deposited. The coupons were then placed in the vapor phase of the boiling solvent blend (90% CFO-1112 and 10% R-43-10mee) for ten minutes. Coupons were then removed and allowed to dry and off-gas for ten minutes before reweighing to determine the cleaning effectiveness factor of the solvent blend. The cleaning effectiveness factor (CEF) was determined by Equation 1, per ASTM G-122. Results of the cleaning analysis are shown in Table 6.

TABLE 6

| Coupon ID | Initial Weight (g) | Oiled Weight (g) | Post-Cleaning Weight (g) | CEF (%) |
|---|---|---|---|---|
| 1A | 20.0274 | 20.0589 | 20.0287 | 95.9 |
| 1B | 20.0880 | 20.1187 | 20.0896 | 94.8 |
| 1C | 20.0812 | 20.1063 | 20.0815 | 98.8 |

Example 7

Cleaning Effectiveness of 80% CFO-1112 and 20% R-356mfc Blend

Three pre-cleaned 304 stainless steel coupons were weighed on an analytical balance. A thin film of Krytox G-100 oil was applied to one surface of each coupon and excess was removed with a wipe. Each coupon was then re-weighed to determine the oiled weight and amount of oil deposited. The coupons were then placed in the vapor phase of the boiling solvent blend for ten minutes. Coupons were then removed and allowed to dry and off-gas for ten minutes before re-weighing to determine the cleaning effectiveness factor of the solvent blend. The cleaning effectiveness factor (CEF) was determined by Equation 1, per ASTM G-122. Results of the cleaning analysis are shown in Table 7.

TABLE 7

| Coupon ID | Initial Weight (g) | Oiled Weight (g) | Post-Cleaning Weight (g) | CEF (%) |
|---|---|---|---|---|
| 1A | 19.9843 | 20.0737 | 19.9847 | 99.6 |
| 1B | 19.6968 | 19.7491 | 19.6972 | 99.2 |
| 1C | 19.8254 | 19.897 | 19.8259 | 99.3 |

Example 8

Cleaning Effectiveness of 90% CFO-1112 and 10% R-153-10mzzy Blend

Three pre-cleaned 304 stainless steel coupons were weighed on an analytical balance. A thin film of silicone oil was applied to one surface of each coupon and excess was wiped removed with a wipe. Each coupon was then re-weighed to determine the oiled weight and amount of oil deposited. The coupons were then placed in the vapor phase of the boiling solvent blend for ten minutes. Coupons were then removed and allowed to dry and off-gas for ten minutes before re-weighing to determine the cleaning effectiveness factor of the solvent blend. The cleaning effectiveness factor (CEF) was determined by Equation 1, per ASTM G-122. Results of the cleaning analysis are shown in Table 8.

TABLE 8

| Coupon ID | Initial Weight (g) | Oiled Weight (g) | Post-Cleaning Weight (g) | CEF (%) |
|---|---|---|---|---|
| 1A | 19.5935 | 19.5968 | 19.5935 | 100.0 |
| 1B | 19.6289 | 19.659 | 19.6289 | 100.0 |
| 1C | 19.7731 | 19.7865 | 19.7732 | 99.3 |

OTHER EMBODIMENTS

1. In some embodiments, the present application provides processes for dissolving a solute, comprising contacting and mixing said solute with a sufficient quantity of a composition comprising 1,2-dichloro-1,2-difluoroethylene.

2. The process of embodiment 1, wherein the solute comprises rosin flux, oil, or a mixture thereof.

3. The process of embodiment 2, wherein the rosin flux is selected from RMA (rosin mildly activated), RA (rosin activated), WS (water soluble), and OA (organic acid) rosin flux, or any mixture thereof.

4. The process of embodiment 2, wherein the oil is selected from mineral oil, motor oil, silicone oil, a fluorinated oil (e.g., a perfluoropolyether such as Kryrox®), or any mixture thereof.

5. The process of any one of embodiments 1 to 4, further comprising recovering the solute from the composition.

6. In some embodiments, the present application provides processes of cleaning a surface, comprising contacting with said surface a composition comprising 1,2-dichloro-1,2-difluoroethylene.

7. The process of embodiment 6, wherein the contacting comprises immersing the surface in a container comprising the composition, spraying the surface with the composition, wiping the surface with a material that has been wet with the composition, or any combination thereof.

8. The process of embodiment 6 or 7, wherein the surface is an integrated circuit device.

9. The process of embodiment 8, wherein the integrated circuit device is a circuit board.

10. The process of any embodiment 6 or 7, wherein the surface is a metal surface.

11. The process of embodiment 10, wherein the metal surface is a stainless steel surface.

12. In some embodiments, the present application provides a process for removing at least a portion of water from the surface of a wetted substrate, comprising:

a) contacting the substrate with a composition comprising 1,2-dichloro-1,2-difluoroethylene; and b) removing the substrate from contact with the composition.

13. The process of embodiment 12, wherein composition further comprises at least one surfactant suitable for dewatering or drying the substrate.

14. The process of embodiment 13, wherein the surfactant is selected from an alkyl dimethyl ammonium isooctyl phosphate, tert-butyl amine, a perfluoroalkyl phosphate, dimethyl decenamide, a fluorinated alkyl polyether, a quaternary ammonium salt, and glycerol monostearate.

15. In some embodiments, the present application provides a process for depositing a fluorolubricant on a surface comprising:

a) combining a fluorolubricant and a solvent, said solvent comprising 1,2-dichloro-1,2-difluoroethylene to form a lubricant-solvent combination;

b) contacting the lubricant-solvent combination with the surface; and c) evaporating the solvent from the surface to form a fluorolubricant coating on the surface.

16. The process of embodiment 15, wherein the surface is selected from a semiconductor material, a metal, a metal oxide, a vapor deposited carbon, and a glass.

17. The process of embodiment 15 or 16, wherein the surface is a magnetic medium.

18. The process of embodiment 17, wherein the magnetic medium is a computer disk.

19. The process of any one of embodiments 15 to 18, wherein the contacting comprises dipping or immersing the surface in a bath comprising the fluorolubricant.

20. The process of any one of embodiments 15 to 18, wherein the contacting comprises spraying or spin coating the surface with the fluorolubricant.

21. The process of any one of embodiments 15 to 20, wherein the fluorolubricant concentration in the lubricant-solvent combination is from about 0.02 weight percent to about 0.5 weight percent.

22. The process of any one of embodiments 15 to 21, wherein the evaporating is performed at a temperature of from about 10° C. to about 40° C.

23. The process of any one of embodiments 15 to 22, wherein the fluorolubricant comprises a perfluoropolyether.

24. The process of any one of embodiments 15 to 22, wherein the fluorolubricant is a perfluoropolyether or a mixture of perfluoropolyethers.

25. The process of any one of embodiments 1 to 24, wherein the composition further comprises a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy.

26. The process of any one of embodiments 1 to 24, wherein the composition further comprises N-pentane.

27. The process of embodiment 25 or 26, wherein the composition comprises about 75 to about 99 weight percent 1,2-dichloro-1,2-difluoroethylene and about 25 to about 1 weight percent n-pentane.

28. The process of embodiment 25 or 26, wherein the composition comprises about 75 to about 95 weight percent 1,2-dichloro-1,2-difluoroethylene and about 25 to about 5 weight percent n-pentane.

29. The process of any one of embodiments 1 to 24, wherein the composition further comprises HFE-7000.

30. The process of embodiment 25 or 29, wherein the composition comprises about 54 to about 99 weight percent 1,2-dichloro-1,2-difluoroethylene and about 46 to about 1 weight percent HFE-7000.

31. The process of embodiment 25 or 29, wherein the composition comprises about 54 to about 86 weight percent 1,2-dichloro-1,2-difluoroethylene and about 46 to about 14 weight percent HFE-7000.

32. The process of any one of embodiments 1 to 24, wherein the composition further comprises R-1233xfB.

33. The process of embodiment 25 or 32, wherein the composition comprises about 62 to about 99 weight percent 1,2-dichloro-1,2-difluoroethylene and about 38 to about 1 weight percent R-1233xfB.

34. The process of embodiment 25 or 32, wherein the composition comprises about 62 to about 91 weight percent 1,2-dichloro-1,2-difluoroethylene and about 46 to about 9 weight percent R-1233xfB.

35. The process of any one of embodiments 1 to 24, wherein the composition further comprises R-1336mzzZ.

36. The process of embodiment 25 or 35, wherein the composition comprises about 60 to about 99 weight percent 1,2-dichloro-1,2-difluoroethylene and about 38 to about 1 weight percent R-1336mzzZ.

37. The process of embodiment 25 or 35, wherein the composition comprises about 60 to about 80 weight percent 1,2-dichloro-1,2-difluoroethylene and about 40 to about 20 weight percent R-1336mzzZ.

38. The process of any one of embodiments 1 to 24, wherein the composition further comprises dimethoxymethane.

39. The process of embodiment 25 or 38, wherein the composition comprises about 1 to about 35 weight percent 1,2-dichloro-1,2-difluoroethylene and about 99 to about 65 weight percent dimethoxymethane.

40. The process of embodiment 25 or 38, wherein the composition comprises about 6 to about 35 weight percent 1,2-dichloro-1,2-difluoroethylene and about 94 to about 65 weight percent dimethoxymethane.

41. The process of any one of embodiments 1 to 24, wherein the composition further comprises R-1345mzzE.

42. The process of embodiment 25 or 41, wherein the composition comprises about 95 to about 60 weight percent 1,2-dichloro-1,2-difluoroethylene and about 5 to about 40 weight percent R-1345mzzE.

43. The process of embodiment 25 or 41, wherein the composition comprises about 93 to about 62 weight percent 1,2-dichloro-1,2-difluoroethylene and about 7 to about 38 weight percent R-1345mzzE.

44. The process of any one of embodiments 1 to 24, wherein the composition further comprises R-43-10mee.

45. The process of embodiment 25 or 44, wherein the composition comprises about 89 to about 99 weight percent 1,2-dichloro-1,2-difluoroethylene and about 11 to about 1 weight percent R-43-10mee.

46. The process of embodiment 25 or 44, wherein the composition comprises about 89 to about 95 weight percent 1,2-dichloro-1,2-difluoroethylene and about 11 to about 5 weight percent R-43-10mee.

47. The process of any one of embodiments 1 to 24, wherein the composition further comprises R-365mfc.

48. The process of embodiment 25 or 47, wherein the composition comprises about 76 to about 99 weight percent 1,2-dichloro-1,2-difluoroethylene and about 24 to about 1 weight percent R-365mfc.

49. The process of embodiment 25 or 47, wherein the composition comprises about 76 to about 95 weight percent 1,2-dichloro-1,2-difluoroethylene and about 24 to about 5 weight percent R-365mfc.

50. The process of any one of embodiments 1 to 24, wherein the composition further comprises tetrahydrofuran.

51. The process of embodiment 25 or 50, wherein the composition comprises about 1 to about 22 weight percent 1,2-dichloro-1,2-difluoroethylene and about 99 to about 78 weight percent tetrahydrofuran.

52. The process of embodiment 25 or 50, wherein the composition comprises about 5 to about 22 weight percent 1,2-dichloro-1,2-difluoroethylene and about 95 to about 78 weight percent tetrahydrofuran.

53. The process of any one of embodiments 1 to 24, wherein the composition further comprises R-153-10mzzy.

54. The process of embodiment 25 or 53, wherein the composition comprises about 87 to about 99 weight percent 1,2-dichloro-1,2-difluoroethylene and about 13 to about 1 weight percent R-153-10mzzy.

55. The process of embodiment 25 or 53, wherein the composition comprises about 87 to about 95 weight percent 1,2-dichloro-1,2-difluoroethylene and about 13 to about 5 weight percent R-153-10mzzy.

56. The process of any one of embodiments 1 to 24, wherein the composition further comprises a compound selected from HFE-7000 and tetrahydrofuran.

57. The process of embodiment 25, wherein the composition comprises:

about 94 weight percent 1,2-dichloro-1,2-difluoroethylene and about 6 weight percent n-pentane; or about 86 weight percent 1,2-dichloro-1,2-difluoroethylene and about 14 weight percent HFE-7000; or about 80 weight percent 1,2-dichloro-1,2-difluoroethylene and about 20 weight percent R-1336mzzZ; or about 7 weight percent 1,2-dichloro-1,2-difluoroethylene and about 93 weight percent dimethoxymethane; or about 90 weight percent 1,2-dichloro-1,2-difluoroethylene and about 10 weight percent R-43-10mee; or about 80 weight percent 1,2-dichloro-1,2-difluoroethylene and about 20 weight percent R-356mfc; or about 90 weight percent 1,2-dichloro-1,2-difluoroethylene and about 10 weight percent R-153-10mzzy.

58. In some embodiments, the present application further provides a composition, comprising:

i) 1,2-dichloro-1,2-difluoroethylene; and ii) a compound selected from HFE-7000 and tetrahydrofuran.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims. It should be appreciated by those persons having ordinary skill in the art(s) to which the present invention relates that any of the features described herein in respect of any particular aspect and/or embodiment of the present invention can be combined with one or more of any of the other features of any other aspects and/or embodiments of the present invention described herein, with modifications as appropriate to ensure compatibility of the combinations. Such combinations are considered to be part of the present invention contemplated by this disclosure.

What is claimed is:

1. A process for depositing a fluorolubricant on a surface comprising:

a) combining a fluorolubricant and a solvent, said solvent comprising i) 1,2-dichloro-1,2-difluoroethylene, and, optionally, ii) a compound selected from N-pentane, HFE-7000, R-1233xfB, R-1336mzzZ, dimethoxymethane, R-1345mzzE, R-43-10mee, R-365mfc, tetrahydrofuran, and R-153-10mzzy, to form a lubricant-solvent combination;

b) contacting the lubricant-solvent combination with the surface; and c) evaporating the solvent from the surface to form a fluorolubricant coating on the surface.

2. The process of claim 1, wherein the surface is selected from a semiconductor material, a metal, a metal oxide, a magnetic medium, a vapor deposited carbon, and a glass.

3. The process of claim 2, wherein the surface is a magnetic medium.

4. The process of claim 3, wherein the magnetic medium is a computer disk.

5. The process of claim 1, wherein the contacting comprises dipping or immersing the surface in a bath comprising the fluorolubricant.

6. The process of claim 1, wherein the contacting comprises spraying or spin coating the surface with the fluorolubricant.

7. The process of claim 1, wherein the fluorolubricant concentration in the lubricant-solvent combination is from about 0.02 weight percent to about 0.5 weight percent.

8. The process of claim 1, wherein the evaporating is performed at a temperature of from about 10° C. to about 40° C.

9. The process of claim 1, wherein the fluorolubricant comprises a perfluoropolyether.

10. The process of claim 1, wherein the fluorolubricant is a perfluoropolyether or a mixture of perfluoropolyethers.

* * * * *